US006149397A

United States Patent [19]

Mizutani et al.

[11] Patent Number: 6,149,397

[45] Date of Patent: Nov. 21, 2000

[54] PRESSURE PULSATIONS REDUCING COMPRESSOR

[75] Inventors: Hideki Mizutani; Hiroaki Kayukawa; Shigeki Kanzaki; Kiyohiro Yamada, all of Kariya, Japan

[73] Assignee: Toyoda Automatic Loom Works, Ltd., Kariya, Japan

[21] Appl. No.: 09/252,631

[22] Filed: Feb. 19, 1999

[30] Foreign Application Priority Data

Mar. 6, 1998 [JP] Japan ..... 10-055148
Sep. 2, 1998 [JP] Japan ..... 10-248584

[51] Int. Cl.[7] ..... F04B 1/26

[52] U.S. Cl. ..... 417/222.2

[58] Field of Search ..... 417/228.2, 416, 417/417, 902

[56] References Cited

U.S. PATENT DOCUMENTS

| | | | |
|---|---|---|---|
| 5,112,198 | 5/1992 | Skinner | 417/269 |
| 5,186,614 | 2/1993 | Abousabha | 417/312 |
| 5,529,461 | 6/1996 | Kawaguchi et al. | 417/222.2 |
| 5,624,240 | 4/1997 | Kawaguchi et al. | 417/222.2 |
| 5,674,054 | 10/1997 | Ota et al. | 417/269 |
| 5,681,150 | 10/1997 | Kawaguchi et al. | 417/222.2 |
| 5,741,122 | 4/1998 | Yokono et al. | 417/222.2 |
| 5,785,502 | 7/1998 | Ota et al. | 417/222.2 |
| 5,807,076 | 9/1998 | Kawaguchi et al. | 417/228 |
| 5,842,834 | 12/1998 | Kawaguchi et al. | 417/222.2 |
| 5,865,604 | 2/1999 | Huang | 417/532 |
| 5,871,337 | 2/1999 | Fukanuma et al. | 417/222.2 |
| 5,971,716 | 10/1999 | Ota et al. | 417/222.2 |
| 6,015,269 | 1/2000 | Ota et al. | 417/222.2 |

FOREIGN PATENT DOCUMENTS

| | | |
|---|---|---|
| 196 44 431 A1 | 4/1997 | Germany . |
| 197 09 935 A1 | 11/1997 | Germany . |
| 10-205466 | 1/1997 | Japan . |

*Primary Examiner*—Teresa Walberg
*Assistant Examiner*—Vinud D Patel
*Attorney, Agent, or Firm*—Woodcock Washburn Kurtz Mackiewicz & Norris LLP

[57] ABSTRACT

In a variable displacement compressor of the invention, cylinder bores (111) and a crankcase (121) are formed in a housing, single-ended pistons (37) are fitted in the cylinder bores (111), and a cam plate (23) is provided in the crankcase (121). The displacement capacity of the compressor is varied by controlling the angle of inclination of the cam plate (23) in accordance with the difference between the internal pressure of the crankcase (121) and an suction pressure present on both sides of each single-ended piston (37). A dampening or muffler chamber (65) is provided downstream of an output channel (114) through which a refrigerant gas discharged from the cylinder bores (111) passes. A check valve (69) which opens and closes in accordance with a pressure difference between upstream and downstream sides of the output channel (114) is provided in the output channel (114), upstream of the muffler chamber (65). The present invention reduces the effects of pressure pulsations caused by the compression motion of the compressor and caused by the valve body of the open/close device hunting, has no bad effects on the external refrigerant circuit connected to the compressor, and increases the reliability of the lip seal.

36 Claims, 5 Drawing Sheets

PRESSURE PULSATIONS REDUCING COMPRESSOR

BACKGROUND OF THE INVENTION AND RELATED ART STATEMENT

1. Field of the Invention

The present invention pertains generally to compressors and, more particularly, relates to compressors provided with a discharge muffler in a discharge passage.

2. Description of the Related Art

It is known that some conventional compressors, including variable displacement compressors, are provided with an expansion-type discharge muffler in a discharge passage for reducing vibrations and acoustic noise generated when the compressors are in operation. The cross-sectional area of a discharge gas passage is enlarged and then reduced in a muffling space formed in the discharge muffler. Discharge gas pressure pulsations are damped in the discharge muffler by causing reflection and interference in its muffling space. Since the discharge gas pressure pulsations are damped in this manner, it is possible to prevent vibrations and acoustic noise which could occur in an external refrigerant circuit due to the pressure pulsations.

In another type of compressor previously proposed, it is provided with a check valve located downstream of a discharge muffler, in which a discharge passage is blocked by the check valve when the compressor is not in operation. In this construction, a high-pressure discharge gas is prohibited from flowing back into the discharge muffler and the compressor from an external refrigerant circuit connected to the discharge passage of the compressor, making it possible to prevent an excessive amount of high-pressure discharge gas from being fed back into the compressor, when it is not in operation.

A conventional compressor employing the aforementioned arrangement, however, would still produce discharge gas pressure pulsations when a valve element of its check valve begins to hunt, and such pressure pulsations are likely to cause the external refrigerant circuit to generate vibrations and acoustic noise. This is mainly because the check valve is provided downstream of the discharge muffler in the discharge passage.

Another problem of the conventional arrangement in which the check valve is provided downstream of the discharge muffler is that the high-pressure discharge gas upstream of the check valve as well as the volumetric capacity of the discharge muffler flows back into a crankcase of the compressor when the compressor is not in operation. This results in an excessive increase in the internal pressure of the crankcase and produces an adverse effect on the durability of a lip-type seal mounted on a rotary shaft of the compressor.

SUMMARY OF THE INVENTION

It is an object of the present invention to provide a compressor which can prevent or minimize the occurrence of pressure pulsations, even when a valve element of a check valve begins to hunt, and to improve the reliability of a lip-type seal without producing any adverse effect on an external refrigerant circuit connected to the compressor.

According to one aspect of the invention, a compressor having a discharge muffler provided in a discharge passage, through which a refrigerant gas discharged from a compression space passes, comprises a discharge passage open/close device which opens and closes in accordance with a pressure difference between an upstream side and a downstream side of the discharge passage, the discharge passage open/close device being provided in the discharge passage upstream of the discharge muffler.

In this construction, the discharge passage open/close device is provided upstream of the discharge muffler, and the open/close device opens and closes in accordance with a pressure difference between the upstream side and the downstream side of the discharge passage open/close device. If pressure pulsations occur, due to hunting of a valve element of the discharge passage open/close device, during opening/closing operation of the discharge passage open/close device, then such pressure pulsations are suppressed by the discharge muffler. Further, since the discharge passage open/close device is provided upstream of the discharge muffler, high-pressure discharge gas in the discharge passage on the downstream side of the open/close device as well as the volumetric capacity of the discharge muffler will not flow back into the compressor when it is not in operation.

According to another aspect of the invention, the aforementioned compressor is a variable displacement compressor. The variable displacement compressor has a cylinder bore and a crankcase that are formed in a housing. A piston is fitted in the cylinder bore, and a cam plate is provided in the crankcase. The displacement capacity of the compressor is varied by controlling the angle of inclination of the cam plate in accordance with the difference between the internal pressure of the crankcase and an suction pressure present on both sides of the piston.

This construction provides the same advantageous effects as described above.

According to still another aspect of the invention, the compressor further comprises a pressure-release channel interconnecting the crankcase and an suction pressure region, a pressure supply channel interconnecting a discharge chamber and the crankcase, and a capacity control valve for opening and closing the pressure supply channel. The capacity control valve opens the pressure supply channel when the compressor is stopped.

If the capacity control valve is opened when the compressor has been stopped in this construction, the refrigerant gas in the discharge chamber is supplied to the crankcase through the pressure supply channel, causing an increase in the internal pressure of the crankcase. As a result of this pressure increase in the crankcase, the refrigerant gas in the crankcase is admitted into the suction pressure region through the pressure-release channel. Although there exists certain chances that lubricating oil in the crankcase may be discharged together with the refrigerant gas, the high-pressure discharge gas, as well as the volumetric capacity of the discharge muffler, would not be supplied back to the crankcase because the discharge passage open/close device is provided upstream of the discharge muffler. This makes it possible to limit the amount of the lubricating oil flowing out of the crankcase through the pressure-release channel to a minimal level.

According to yet another aspect of the invention, the aforementioned housing is constructed of a front housing block in which the crankcase swingably accommodating the cam plate is formed, a cylinder block which is connected to the front housing block and accommodates a single-ended piston which moves back and forth as a result of a rotary motion of the cam plate, and a rear housing block which is connected to the cylinder block. The aforementioned discharge muffler is preferably formed bridging a joint between the cylinder block and the front housing block.

This construction provides the same advantageous effect as the aforementioned constructions.

According to a further aspect of the invention, the aforementioned discharge passage open/close device is provided in the discharge passage which is formed in the rear housing block.

This construction provides the same advantageous effect as the aforementioned constructions.

According to a further aspect of the invention, the discharge passage formed in the rear housing block includes an accommodating compartment which is formed between and opens to a joint surface of the rear housing block facing the cylinder block. The aforementioned discharge passage open/close device is fitted in the accommodating compartment.

Since the accommodating compartment, opening to the joint surface of the rear housing block facing the cylinder block, is provided in the discharge passage in the rear housing block, the discharge passage open/close device can be easily installed in the accommodating compartment from the joint surface of the rear housing block.

According to a further aspect of the invention, the aforementioned discharge passage open/close device is a check valve.

This construction provides the same advantageous effect as the aforementioned constructions.

According to a still further aspect of the invention, the aforementioned discharge passage open/close device is a check valve comprising a valve element which is shifted between a position where it blocks the discharge passage and a position where it opens the discharge passage, and a spring which forces the valve element toward the position where it blocks the discharge passage.

In this construction, the discharge passage conducts when the pressure on the upstream side of the check valve exceeds the sum of the pressure on the downstream side of the check valve and the elastic side of the spring, whereas the discharge passage is closed when the pressure on the upstream side of the check valve becomes lower than the sum of the pressure on the downstream side of the check valve and the elastic side of the spring.

According to the aforementioned constructions of the invention, it is possible to prevent the occurrence of pressure pulsations, even when the valve element of the check valve begins to hunt, and to improve the reliability of a lip-type seal without producing any adverse effect on an external refrigerant circuit connected to the compressor.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an exemplary embodiment that is presently preferred, it being understood, however, that the invention is not limited to the specific methods and instrumentalities disclosed. In the drawings.

DETAILED DESCRIPTION OF THE PREFERRED EMBODIMENTS OF THE INVENTION

The invention is now described in detail, by way of example, with reference to its currently preferred embodiment in a clutchless variable displacement compressor, as depicted in FIGS. 1 to 6.

Figure 1:
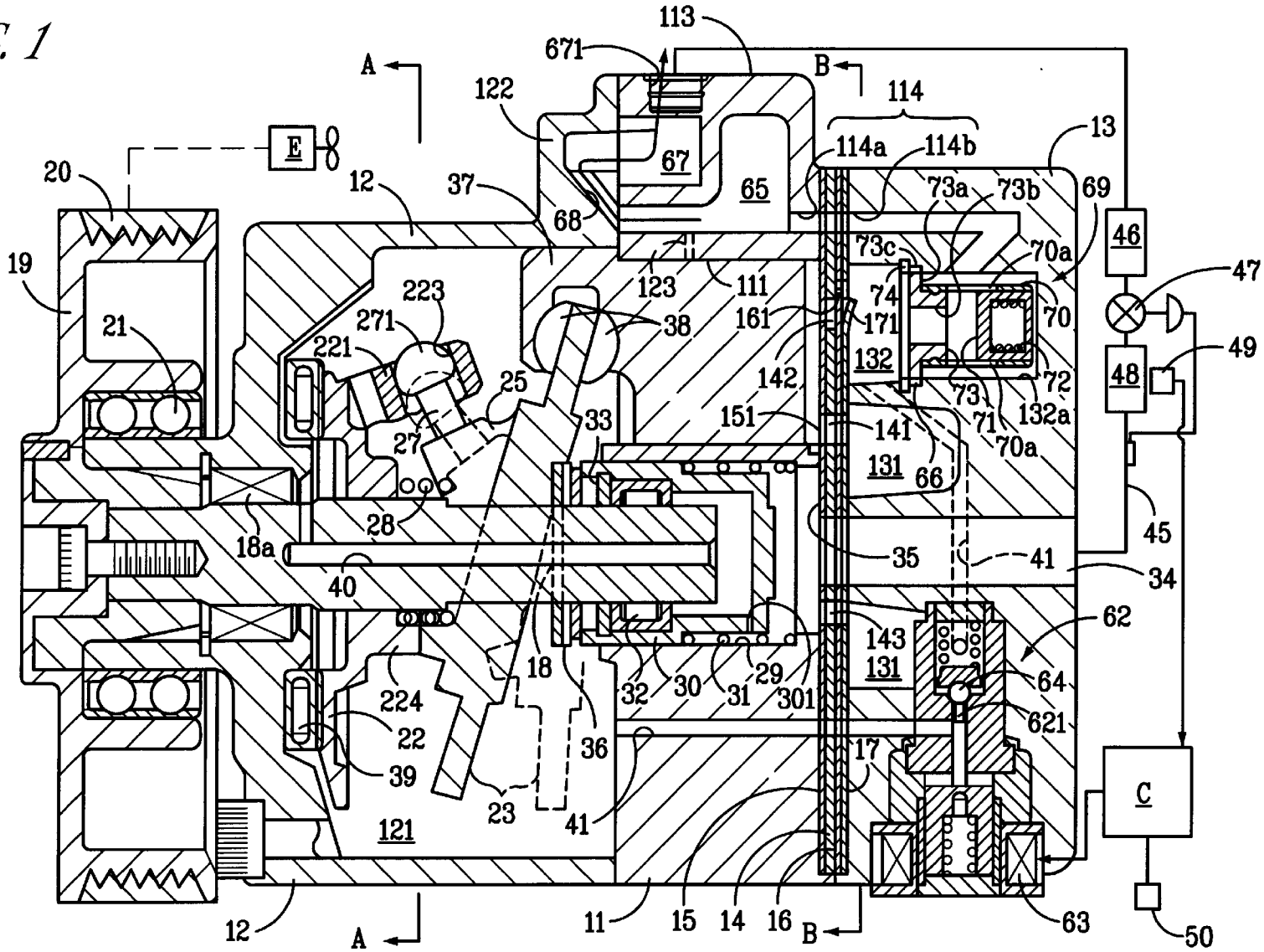
FIG. 1 is an overall cross-sectional side view of a compressor according to a preferred embodiment of the invention.

As shown in FIG. 1, a front housing block 12 is joined to a front end of a cylinder block 11, and a rear housing block 13 is firmly joined to the a rear end of the cylinder block 11 with a valve plate 14, valve-forming plates 15, 16 and a retainer-forming plate 17 placed in between. The front housing block 12, the cylinder block 11, and the rear housing block 13 thus assembled together form a housing of the compressor. A rotary shaft 18 is rotatably supported between the front housing block 12, in which a crankcase 121 is formed, and the cylinder block 11. A front end portion of the rotary shaft 18 protrudes outward from the crankcase 121 and a pulley 19 is firmly mounted on the front end portion of the rotary shaft 18. The pulley 19 is connected to a vehicle engine E by a belt 20 and is supported by the front housing block 12 by way of an angular bearing 21. The front housing block 12 sustains loads exerted on the pulley 19 both in its axial (thrust) and radial directions via the angular bearing 21.

There is fitted a lip-type seal 18a on the rotary shaft 18, between the front end portion of the rotary shaft 18 and the front housing block 12. The lip-type seal 18*a* serves to prevent pressure leakage from the crankcase 121.

Figure 2:
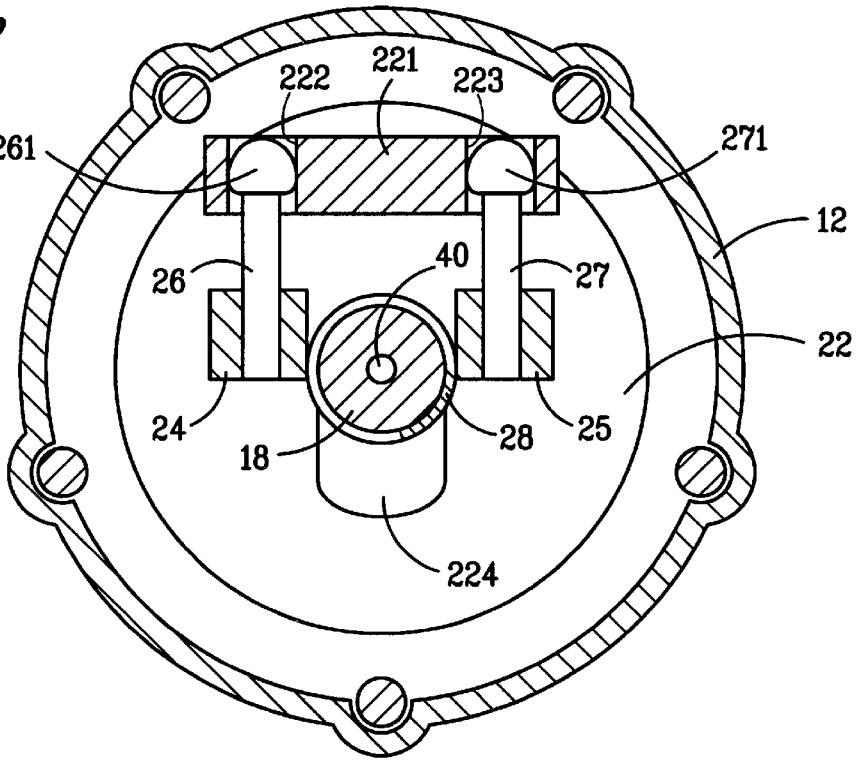
FIG. 2 is a cross-sectional view taken along lines A—A of FIG. 1.
Figure 4:
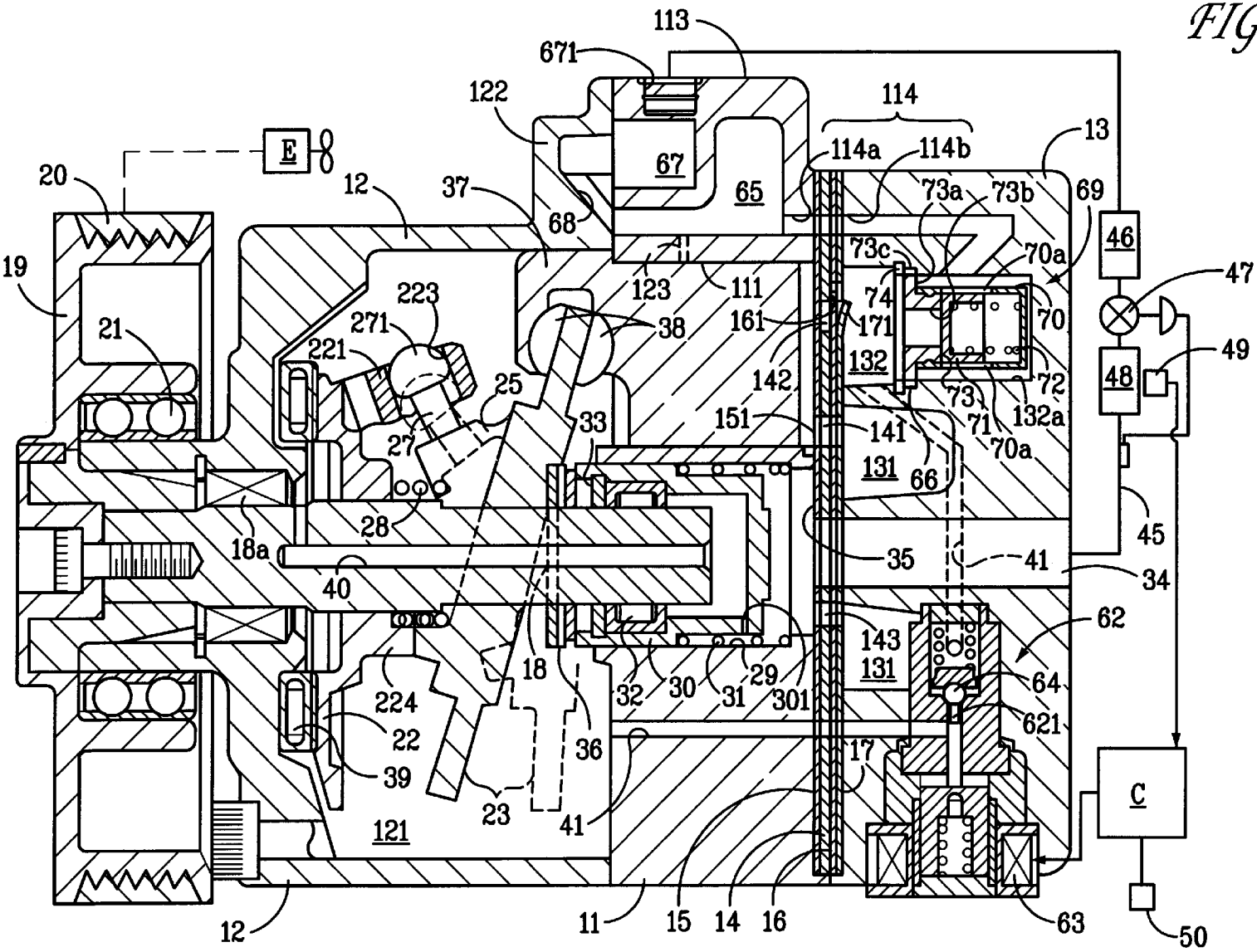
FIG. 4 is an overall cross-sectional side view of the compressor when a cam plate is at its minimum angle of inclination.

A rotary support 22 is firmly fitted on the rotary shaft 18. The rotary shaft 18 also supports a cam plate 23 allowing the cam plate 23 to slide along the rotary shaft 18 and be inclined in an axial direction of the rotary shaft 18. A pair of connecting parts 24, 25 are affixed to the cam plate 23 and guide pins 26,27 are firmly fitted in the respective connecting parts 24, 25, as shown in FIGS. 2 and 4. Guide spheres 261, 271 are formed at extreme ends of the guide pins 26, 27, respectively. The rotary support 22 is provided with a projecting supporting arm 221, and a pair of guide holes 222, 223 are formed in the supporting arm 221. The guide spheres 261, 271 of the guide pins 26, 27 are slidably fitted in the guide holes 222, 223, respectively. As the guide pins 26, 27 are connected to the supporting arm 221 in this way, the cam plate 23 can be inclined in the axial direction of the rotary shaft 18 and rotate together with the rotary shaft 18. When the angle of inclination of the cam plate 23 is varied, it is properly guided as the guide holes 222,223 and the guide spheres 261,271 together work as slide guides and the rotary shaft 18 slidably supports the cam plate 23. The angle of inclination of the cam plate 23 decreases when a central part of the cam plate 23 moves toward the cylinder block 11.

An inclination reducing spring 28 is fitted between the rotary support 22 and the cam plate 23. The inclination reducing spring 28 forces the cam plate 23 in a direction in which the angle of inclination of the cam plate 23 is reduced.

As shown in FIGS. 1 and 4, an accommodating hole 29 is formed in a central part of the cylinder block 11 in the axial direction of the rotary shaft 18. A generally cylinder shaped cutoff member 30 is slidably fitted in the accommodating hole 29 and an suction passage opening spring 31 is fitted between the cutoff member 30 and an end surface of the accommodating hole 29. The suction passage opening spring 31 pushes the cutoff member in the direction of the cam plate 23.

A rear end portion of the rotary shaft 18 is fitted in a cylindrical cavity of the cutoff member 30. A radial bearing 32 is fitted and supported on a cylindrical inner surface of the cutoff member 30. While the radial bearing 32 is slidable along the rotary shaft 18, it is prevented from coming off the cylindrical cavity of the cutoff member 30 by a snap ring 33 fitted on the cylindrical inner surface of the cutoff member 30. The rear end portion of the rotary shaft 18 is supported by a cylindrical inner surface of the accommodating hole 29 via the radial bearing 32 and the cutoff member 30.

An suction passage 34 is formed in a central part of the rear housing block 13. The suction passage 34 is located on a line extended from the rotary shaft 18 that defines a moving path of the cutoff member 30. The suction passage 34 is connected to the accommodating hole 29 and a positioning surface 35 is formed on the valve-forming plate 15 around an opening of the suction passage 34 facing the accommodating hole 29. A forward end surface of the cutoff member 30 can go into contact with the positioning surface 35. The cutoff member 30 is prohibited from moving further away from the cam plate 23 when the forward end surface of the cutoff member 30 comes into contact with the positioning surface 35.

A thrust bearing 36 is slidably fitted on the rotary shaft 18 just between the cam late 23 and the cutoff member 30. The thrust bearing 36 is constantly fastened between the cam plate 23 and the cutoff member 30 due to a pushing force exerted by the suction passage opening spring 31.

As the cam plate 23 moves toward the cutoff member 30, inclining motion of the cam plate 23 is transmitted to the cutoff member 30 via the thrust bearing 36. The inclining motion of the cam plate 23 thus transmitted causes the cutoff member 30 to move toward the positioning surface 35 overwhelming the pushing force of the suction passage opening spring 31 and eventually come in contact with the positioning surface 35. The thrust bearing 36 prevents rotary motion of the cam plate 23 from being transmitted to the cutoff member 30.

Single-ended pistons 37 are fitted in cylinder bores 111 formed in the cylinder block 11. The rotary motion of the cam plate 23 is converted into reciprocating motion of the single-ended pistons 37 via shoes 38, causing the single-ended pistons 37 to move back and forth in the individual cylinder bores 111.

Figure 3:
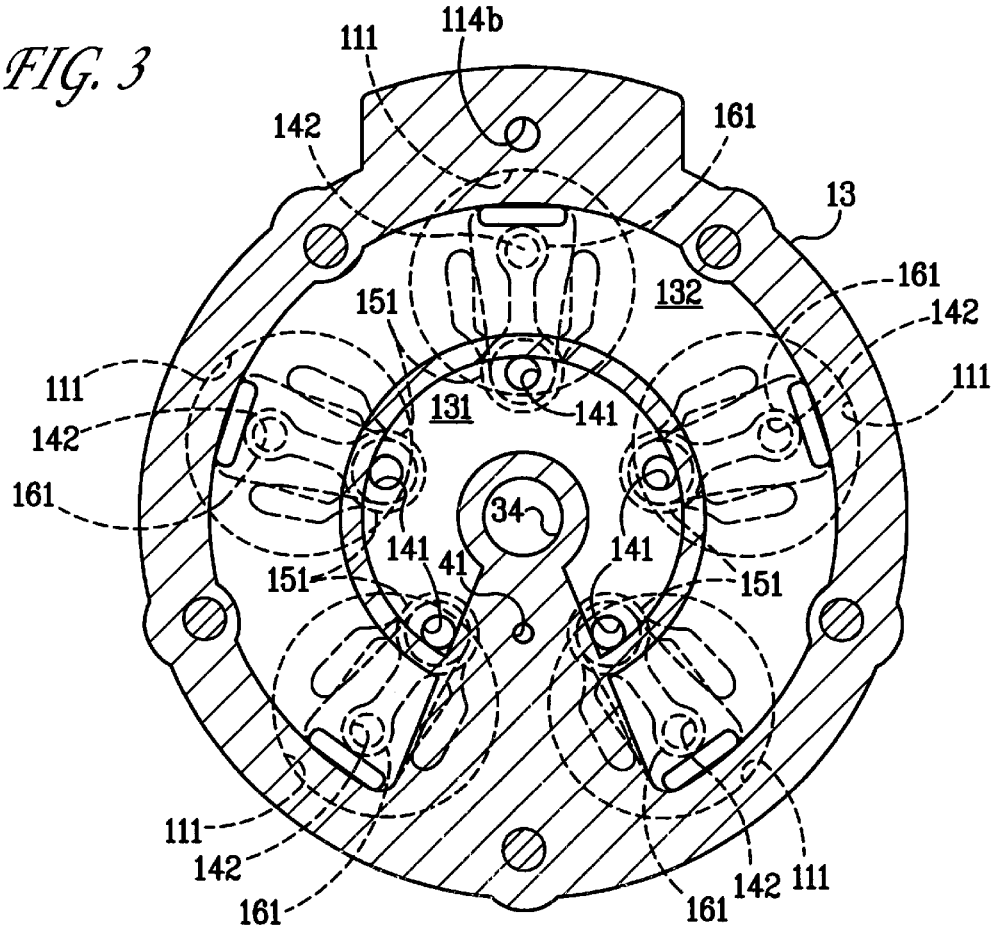
FIG. 3 is a cross-sectional view taken along lines B—B of FIG. 1.

As shown in FIGS. 1 and 3, an suction chamber 131 and a discharge chamber 132 separated from each other are formed in the rear housing block 13. Suction ports 141 and discharge ports 142 are formed in the valve plate 14. Suction valves 151 are formed on the valve-forming plate 15 while discharge valves 161 are formed on the valve-forming plate 16. As a result of the reciprocating motion of the single-ended pistons 37, a refrigerant gas in the suction chamber 131 pushes out the suction valves 151, passes through the suction ports 141, and is introduced into the respective cylinder bores (compression space) 111. The refrigerant gas introduced into the cylinder bores 111 is then compressed, pushes out the discharge valves 161, passes through the discharge ports 142, and is expelled into the discharge chamber 132. The discharge valves 161 come into contact with their corresponding retainers 171 formed on the retainer-forming plate 17, where the opening of the discharge valves 161 is constrained.

There is provided a thrust bearing 39 between the rotary support 22 and the front housing block 12. The thrust bearing 39 sustains a compressive load exerted on the rotary support 22 from the cylinder bores 111 through the single-ended pistons 37, the shoes 38, the cam plate 23, the connecting parts 24, 25, and the guide pins 26, 27.

The suction chamber 131 is connected to the accommodating hole 29 via a through hole 143. When the cutoff member 30 comes into contact with the positioning surface 35, the through hole 143 is interrupted from the suction passage 34.

The suction passage 34, the through hole 143, the accommodating hole 29, and the suction chamber 131 mentioned above together constitute an suction pressure region.

An internal channel 40 connecting the crankcase 121 to the cylindrical cavity of the cutoff member 30 is formed within the rotary shaft 18. A pressure-release hole 301 is formed in a cylindrical wall of the cutoff member 30, as shown in FIG. 1. The pressure-release hole 301 connects the cylindrical cavity of the cutoff member 30 and the accommodating hole 29 to each other.

The internal channel 40, the cylindrical cavity of the cutoff member 30 and the pressure-release hole 301 mentioned above together constitute a pressure-release channel.

There is formed a dampening or muffler chamber 65 in the discharge passage, which serves as a discharge muffler preferably formed on the curved outer surfaces of the cylinder block 11 and the front housing block 12. The dampening chamber 65 is preferably of an expansion type and is constructed of two parts, that is, a structural wall 113 formed as an integral part of the cylinder block 11, and a structural wall 122 formed as an integral part of the front housing block 12. An output channel 114 of the dampening chamber 65 has a circular cross section and includes channel segments 114*a* and 114*b* formed in the cylinder block 11 and the rear housing block 13, respectively. The output channel 114 connects the dampening chamber 65 to the discharge chamber 132. The channel segment 114*a* is formed at right angles to a rear end surface (butt end to be joined to the rear housing block 13) of the cylinder block 11 and has a circular opening in cross section.

A front part of the channel segment 114*b* is formed at right angles to a front end surface (butt end to be joined to the cylinder block 11) of the rear housing block 13 and has a circular opening in cross section, while a rear part of the channel segment 114*b* is formed obliquely from the side of the discharge chamber 132 and opens into a later-described accommodating compartment 132*a*. The channel segment 114*b* is generally V-shaped in side view, as shown in FIG. 1. The channel segments 114*a* and 114*b* are arranged face to face with each other and interconnected through circular openings formed in the valve plate 14 and the valve-forming plates 15, 16. Since the channel segments 114*a* and 114*b* each have a circular opening in cross section, the opening area of each channel segment 114*a*, 114*b* is minimized in relation to the area of the butt ends of the cylinder block 11 and the rear housing block 13.

Furthermore, although not specifically illustrated in the drawings, gaskets are placed between the valve-forming plate 15 and the cylinder block 11 and between the valve forming plate 16 and the rear housing block 13. Since the opening area of each channel segment 114*a*, 114*b* is minimized, it is possible to minimize openings to be formed in the gaskets corresponding to the channel segments 114*a* and 114*b*.

The dampening chamber 65 may be connected to the crankcase 121 through an optional throttle channel 123. The throttle channel 123 is provided for supplying lubricating oil separated from the refrigerant gas in the dampening chamber 65 back into the crankcase 121 to ensure that the lubricating oil recovered in the dampening chamber 65 is used for lubricating such components in the crankcase 121 that require lubrication.

The refrigerant gas driven out from the cylinder bores 111 into the discharge chamber 132 is delivered from the output channel 114 to the dampening chamber 65, Mere discharge gas pressure pulsations are reduced.

There is formed a refrigerant channel 67 in the structural wall 113, the refrigerant channel 67 having a discharge opening 671 connected to an external refrigerant circuit 45. The refrigerant channel 67 opens at an end surface of the structural wall 113 to be joined to the structural wall 122 and extends in a horizontal direction. The discharge opening 671 opens at an upper surface of the structural wall 113 and extends in a vertical direction. There is formed a connecting channel 68 in the structural wall 122 for connecting the dampening chamber 65 to the refrigerant channel 67.

The refrigerant channel 67, the dampening chamber 65, the output channel 114 and the discharge chamber 132 mentioned above together constitute a discharge passage.

The aforementioned accommodating compartment 132*a* has a circular cross section and is formed in the back of the discharge chamber 132. An open/close device 69 is fitted in the accommodating compartment 132*a*. The open/close device 69 is disposed in the discharge passage upstream of the dampening chamber 65. Preferably, the open/close device 69 comprises a check valve. The check valve 69 is constructed as a one-piece unit including a casing 70, a valve element 71, a spring 72 and a stopper 73. The casing 70 has a cylindrical shape with its one end readily closed. The valve element 71 also having a cylindrical shape with its one end closed is fitted in the casing 70 slidably along a longitudinal axis of the casing 70. The spring 72 forces the valve element 71 in the direction of an open end of the casing 70. The stopper 73 is securely fitted at the open end of the casing 70 in a manner that the valve element 71 can come in contact with an inner end surface of the stopper 73. There is formed a flange 73*a* around an outer end of the stopper 73 and an O-ring 73*c* is fitted around a curved outer surface of the flange 73*a*.

There is formed a raised step 66 on a cylindrical inner surface of the accommodating compartment 132*a* so that the flange 73*a* can be seated on the raised step 66. When the check valve 69 is fitted into the accommodating compartment 132*a* in a manner that the flange 73*a* is properly seated on the raised step 66, a snap ring 74 fitted in the cylindrical inner surface of the accommodating compartment 132*a* prevents the check valve 69 from coming off the accommodating compartment 132*a*. The aforementioned O-ring 73*c* hermetically seals a gap between a curved inner surface of the raised step 66 and the flange 73*a*. A valve hole 73*b* is formed in the stopper 73 in order to connect a more front portion of the discharge chamber 132 than the accommodating compartment 132*a* to the interior space of the casing 70. A plurality of through holes 70*a* are formed in the surrounding wall of the casing 70.

Figure 6:
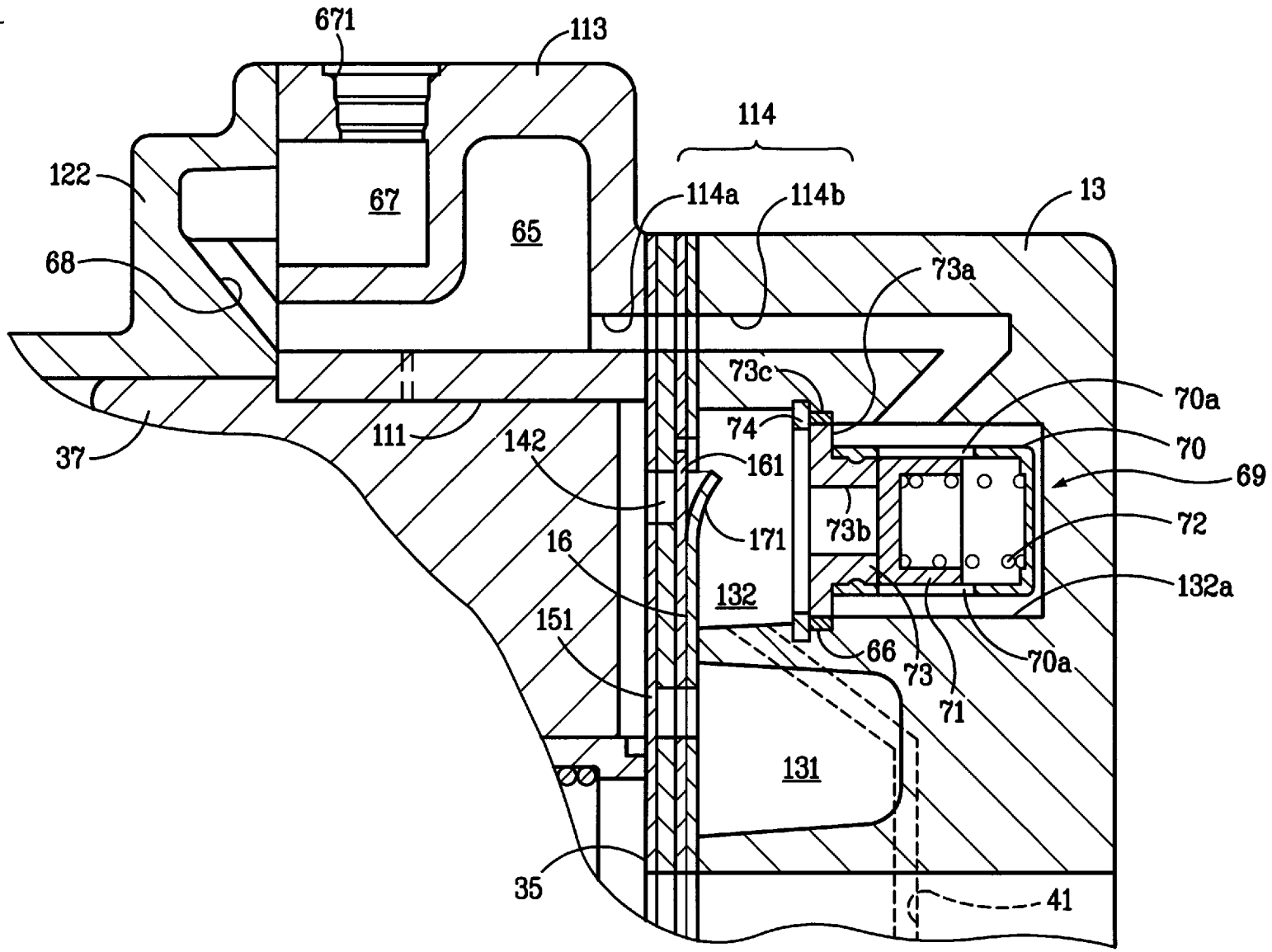
FIG. 6 shows the check valve of the compressor of FIG. 1 in its closed state.

When the compressor is operated at its minimum displacement capacity, the valve element 71 comes into contact with the inner end surface of the stopper 73 and closes off the valve hole 73*b*, as shown in FIGS. 4 and 6.

Figure 5:
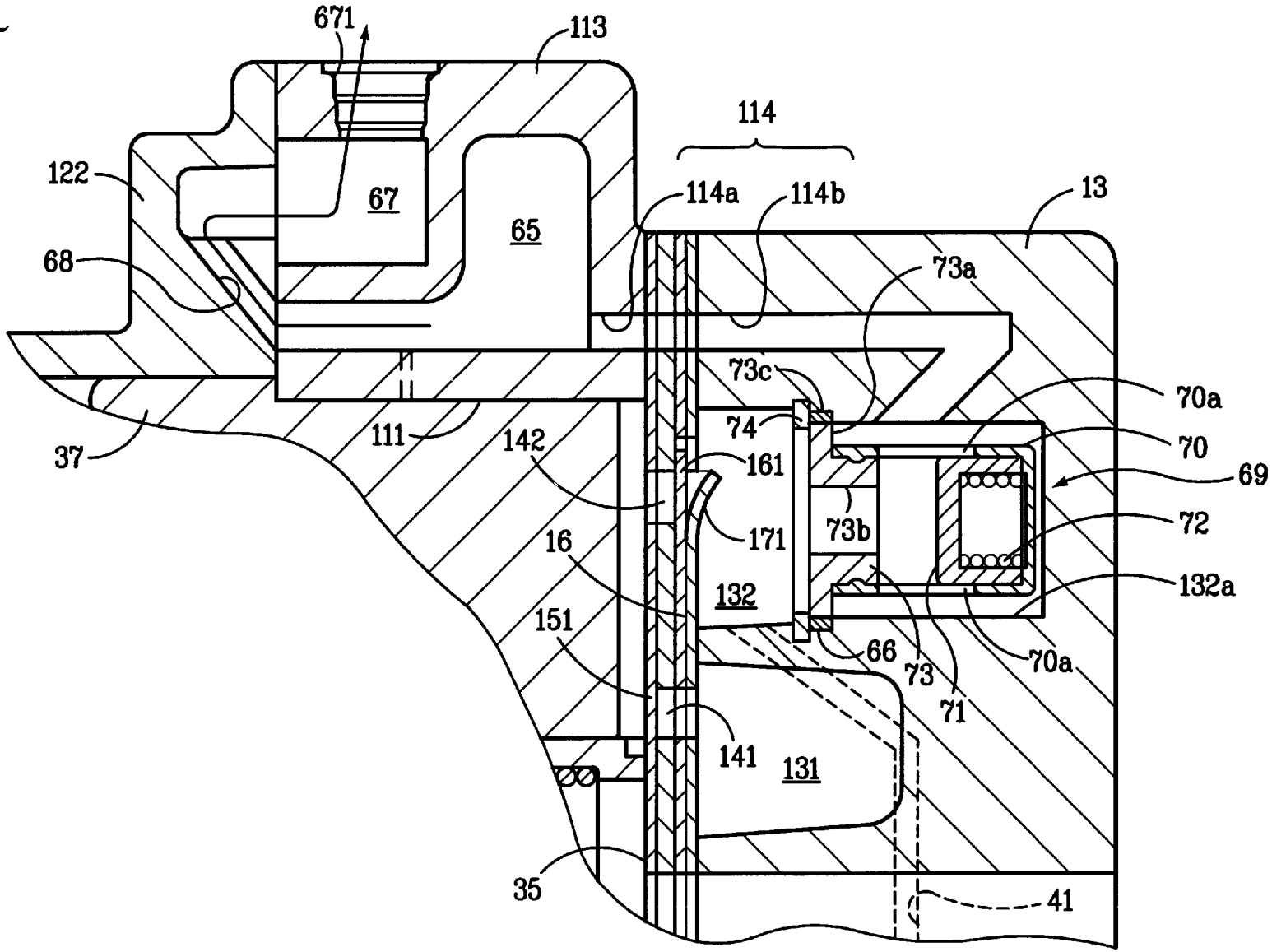
FIG. 5 shows the check valve of the compressor of FIG. 1 in its opened state.

When the compressor is operated at a displacement capacity greater than its minimum displacement capacity, the valve element 71 comes off the valve hole 73*b* due to the pressure in the front portion of the discharge chamber 132 and thereby releases the accommodating compartment 132*a*, as shown in FIGS. 1 and 5.

The suction passage 34 through which the refrigerant gas is introduced into the suction chamber 131 and the discharge opening 671 are connected to each other by the external refrigerant circuit 45 which includes a condenser 46, an expansion valve 47, and an evaporator 48. The expansion valve 47 is preferably a temperature-operated automatic expansion valve which controls the flow rate of the refrigerant gas according to variations in gas temperature at an output of the evaporator 48.

As shown in FIG. 1, the front portion of the discharge chamber 132 and the crankcase 121 are connected to each other by a pressure supply channel 41, in which a capacity control valve 62 is provided.

A valve hole 621 is closed by the valve element 64 when a solenoid 63 of the capacity control valve 62 is excited. When the solenoid 63 is de-excited, a valve element 64 of the capacity control valve 62 opens the valve hole 621. This means that the capacity control valve 62 opens and closes the pressure supply channel 41 which interconnects the discharge chamber 132 and the crankcase 121.

A temperature sensor 49 is provided in the vicinity of the evaporator 48. The temperature sensor 49 senses the temperature of the evaporator 48 and transmits resultant temperature information to a computer C. The solenoid 63 of the capacity control valve 62 is excited and de-excited under the control of the computer C, which controls excitation and de-excitation cycles of the solenoid 63 based on the temperature information fed from the temperature sensor 49. The computer C transmits a command to de-excite the solenoid 63 when the temperature detected by the temperature sensor 49 becomes lower than a set temperature while an air-conditioner on/off switch 50 is set to its on position. Temperatures lower than the set temperature correspond to conditions in which frost would potentially deposit on the evaporator 48. The computer C also de-excites the solenoid 63 when the conditioner on/off switch 50 is turned off.

The pressure supply channel 41 is closed when the solenoid 63 is in its excited state. Thus, a high-pressure refrigerant gas is not supplied from the discharge chamber 132 to the crankcase 121. In this condition, the refrigerant gas in the crankcase 121 simply flows into the suction chamber 131 through the internal channel 40 of the rotary shaft 18 and the pressure-release hole 301 so that the pressure in the crankcase 121 approaches the low pressure, or suction pressure, of the suction chamber 131. Therefore, the cam plate 23 is held in its maximum angle of inclination and the displacement capacity of the compressor is maximized. The maximum angle of inclination of the cam plate 23 is defined when the cam plate 23 comes into contact with an inclination setting projection 224 jutting out from the rotary support 22.

If the refrigerant gas is discharged while the cam plate 23 is maintained at its maximum angle of inclination at a reduced load in cooling operation, the temperature of the evaporator 48 decreases and approaches a temperature range in which frost could occur. As stated above, the temperature sensor 49 transmits the temperature information of the evaporator 48 to the computer C and the computer C transmits a command to de-excite the solenoid 63 when the temperature detected by the temperature sensor 49 becomes lower than the set temperature. When the solenoid 63 is de-excited, the pressure supply channel 41 is caused to draw so that the crankcase 121 is connected to the discharge chamber 132. As a result, the high-pressure refrigerant gas in the discharge chamber 132 is supplied to the crankcase 121 through the pressure supply channel 41, causing an increase in the pressure in the crankcase 121. The pressure increase in the crankcase 121 causes the cam plate 23 to shift toward its minimum angle of inclination. The computer C also de-excites the solenoid 63 when an OFF signal is fed from the air-conditioner on/off switch 50, causing the cam plate 23 to shift to its minimum angle of inclination.

When the cam plate 23 reaches its minimum angle of inclination, the cutoff member 30 comes into contact with the positioning surface 35 and, thus, the suction passage 34 is blocked. The cutoff member 30 whose movement is interlocked with the inclining motion of the cam plate 23 gradually decreases the cross-sectional area of a gas passage connected to the suction passage 34. Such gradual decrease in the cross-sectional area of the gas passage connected to the suction passage 34 produces a throttling effect so that the rate at which the refrigerant gas flows into the suction chamber 131 through the suction passage 34 gradually decreases. Accordingly, the rate at which the refrigerant gas flows from the suction chamber 131 into the cylinder bores (compression space) 111 also decreases gradually, resulting in a gradual decrease in the displacement capacity of the compressor. Since the discharge pressure gradually decreases in this manner, a torque to be produced in the compressor would not significantly vary in a short period of time. Thus, the rate of change in the torque to be produced in the clutchless compressor from its maximum displacement capacity to minimum displacement capacity is reduced and, as a consequence, shocks caused by variations in the required torque are alleviated.

When the cutoff member 30 comes into contact with the positioning surface 35, the cross-sectional area of the gas passage connected to the suction passage 34 becomes zero and a flow of the refrigerant gas from the external refrigerant circuit 45 into the suction chamber 131 is prohibited. This means that the circulation of the refrigerant gas through the external refrigerant circuit 45 is completely stopped in this situation. Thus, the cam plate 23 is set to its minimum angle of inclination when the cutoff member 30 comes into contact with the positioning surface 35.

The minimum angle of inclination of the cam plate 23 is slightly larger than zero degrees. The state of this minimum angle of inclination is achieved when the cutoff member 30 is located at a passage closing position where the cutoff member 30 causes the suction passage 34 and the accommodating hole 29 to be disconnected from each other. The cutoff member 30 moves between the passage closing position and a passage opening position separated from the passage closing position in accordance with the movement of the cam plate 23.

Since the minimum angle of inclination of the cam plate 23 is not zero degrees, the refrigerant gas is discharged from the cylinder bores 111 into the discharge chamber 132 even when the cam plate 23 is in its minimum angle of inclination. The refrigerant gas discharged from the cylinder bores 111 into the discharge chamber 132 flows into the crankcase 121 through the pressure supply channel 41. The refrigerant gas in the crankcase 121 flows into the suction chamber 131 through the pressure-release channel including the internal channel 40 of the rotary shaft 18 and the pressure-release hole 301 while the refrigerant gas in the suction chamber 131 is sucked into the cylinder bores 111 and forced out into the discharge chamber 132.

It would be recognized from the above discussion that there is formed a circulatory passage in the compressor passing through the discharge chamber 132 which belongs to a discharge pressure region, the pressure supply channel 41, the crankcase 121, the internal channel 40, the pressure-release hole 301, the accommodating hole 29 which belongs to the suction pressure region, the suction chamber 131 which belongs to the suction pressure region, and the cylinder bores 111 when the cam plate 23 is in its minimum angle of inclination. In this circulatory passage, pressure differences occur between the discharge chamber 132, the crankcase 121 and the suction chamber 131. As the refrigerant gas circulates through the circulatory passage, the lubricating oil fluidized in the circulating refrigerant gas lubricates the inside of the compressor.

The discharge pressure is low when the cam plate 23 is in its minimum angle of inclination. The pushing force of the spring 72 is so determined that the pressure on the upstream side of the check valve 69 is lower than the sum of the pressure on the downstream side of the check valve 69 and the pressure on the downstream side of the check valve spring 72 in this condition. Therefore, the valve element 71 closes the valve hole **73*b* when the angle of inclination of the cam plate 23** is minimized.

When the angle of inclination of the cam plate 23 somewhat increases from its minimum angle of inclination, the cutoff member 30 comes apart from the positioning surface 35. As the cutoff member 30 moves away from the positioning surface 35, the cross-sectional area of the gas passage connected to the suction passage 34 gradually increases so that the rate at which the refrigerant gas flows into the suction chamber 131 through the suction passage 34 gradually increases. Accordingly, the rate at which the refrigerant gas sucked from the suction chamber 131 into the cylinder bores 111 also increases gradually, resulting in a gradual increase in the displacement capacity of the compressor. Since the discharge pressure gradually increases in this manner, the torque to be produced in the compressor would not significantly vary in a short period of time. Thus, the rate of change in the torque to be produced in the clutchless compressor from its minimum displacement capacity to maximum displacement capacity is reduced and, as a consequence, shocks caused by variations in the required torque are alleviated.

When the angle of inclination of the cam plate 23 increases from its minimum angle of inclination, the discharge pressure increases and the pressure on the upstream side of the check valve 69 in the output channel 114 becomes higher than the sum of the pressure on the downstream side of the check valve 69 and the pushing force of the spring 72. Thus, when the angle of inclination of the cam plate 23 is greater than its minimum angle of inclination, the valve hole **73*b* is opened so that the refrigerant gas in the discharge chamber 132 flows into the external refrigerant circuit 45**.

When the vehicle engine E is stopped, the compressor is also stopped so that the cam plate 23 stops rotating and the capacity control valve 62 is de-excited. The cam plate 23 is brought to its minimum angle of inclination upon de-excitation of the capacity control valve 62. Although the pressure in the compressor becomes even throughout its internal spaces if the compressor is left in an non-operating condition for a prolonged time period, the cam plate 23 is maintained at a small angle of inclination due to an elastic force of the inclination reducing spring 28. Accordingly, when the compressor is started following a startup of the vehicle engine E, the cam plate 23 begins to rotate from its minimum angle of inclination at which a minimal startup torque is required so that the compressor produces minimal startup shocks.

The clutchless compressor according to the preferred embodiment of the invention in which the displacement capacity is varied in the above-described manner provides the following advantageous effects:

(1) According to the foregoing embodiment, the open/close device 69, preferably a check valve, provided upstream of the dampening chamber 65 opens and closes in accordance with a pressure difference between the upstream side and the downstream side of the check valve 69. Since a check valve 69 has conventionally been provided downstream of the dampening chamber 65, there has been no means for suppressing discharge gas pressure pulsations when a valve element 71 of the check valve begins to hunt in the conventional arrangement. In the embodiment of the invention, however, it is possible to suppress the pressure pulsations, resulting from the hunting of the valve element 71 during the opening/closing operation of the check valve 69, by positioning the dampening chamber 65 downstream of the check valve 69. It is therefore possible to prevent an adverse effect on the external refrigerant circuit 45.

(2) Since the open/close device 69 is provided upstream of the dampening chamber 65 in this embodiment, it is possible to prevent the high-pressure discharge gas, as well as the volumetric capacity of the dampening or muffler chamber 65 from flowing back into the crankcase 121 through the pressure supply channel 41 while the compressor is not in operation. Consequently, the internal pressure of the crankcase 121 will not increase excessively and an improvement in the durability of the lip-type seal 118*a* provided on the rotary shaft 18 of the compressor can be achieved.

(3) There is provided the pressure-release channel (including the internal channel 40, the cylindrical cavity of the cutoff member 30 and the pressure-release hole 301) which interconnects the crankcase 121 and the suction pressure region (including the suction passage 34, the through hole 143, the accommodating hole 29 and the suction chamber 131) in this embodiment. There are also provided the pressure supply channel 41 which interconnects the discharge chamber 132 and the crankcase 121, as well as, the capacity control valve 62 which opens and closes the pressure supply channel 41. The capacity control valve 62 thus provided opens the pressure supply channel 41 while the compressor is not in operation.

If the capacity control valve 62 is opened when the compressor has been stopped in this construction, the refrigerant gas in the discharge chamber 132 is supplied to the crankcase 121 through the pressure supply channel 41, causing an increase in the internal pressure of the crankcase 121. As a result of this pressure increase in the crankcase 121, the refrigerant gas in the crankcase 121 is admitted into the suction chamber 131, etc. which belong to the suction pressure region through the internal channel 40, etc. which belong to the pressure-release channel. Although there exists certain chances that the lubricating oil in the crankcase 121 may be discharged together with the refrigerant gas, the high-pressure discharge gas, as well as the volumetric capacity of the dampening chamber 65 will not be supplied to the crankcase 121 because the open/close device 69 is provided upstream of the dampening chamber 65. This makes it possible to limit the amount of the lubricating oil flowing out of the crankcase 121 through the internal channel 40, etc. which belong to the pressure-release channel to a minimal level.

(4) One of general characteristics of the compressor is that it has a relatively quick warms up and easily cools down compared to the condenser 46 and the evaporator 48 which are heat exchangers provided in the external refrigerant circuit 45. For this reason, the refrigerant gas in the external refrigerant circuit 45 tends to flow into the compressor when it is not in operation. The refrigerant gas which has flown into the compressor when it is not run tends to liquefy and remains in the compressor. If the liquefied refrigerant deposits in the compressor, the lubricating oil which is circulated together with the refrigerant gas is diluted and the internal components of the compressor to be lubricated by the lubricating oil are washed by the liquefied refrigerant. Thus, if the compressor is started after it has not been operated for an extended period of time, it is likely that abnormal wear or binding may occur on the components for which lubrication is essential.

In this embodiment, however, the open/close device 69 prevents the refrigerant gas in the external refrigerant circuit 45 from flowing into the discharge chamber 132 while the cutoff member 30 prevents the refrigerant gas in the external refrigerant circuit 45 from flowing into the suction chamber 131 when the cam plate 23 is in its minimum angle of inclination. Accordingly, there is less chance of abnormal wear or binding within the compressor due to a deposit of the liquefied refrigerant.

(5) When the cam plate 23 is in its minimum angle of inclination, the valve element 64 of the capacity control valve 62 is in a position where the valve hole 621 is not closed so that there is formed the circulatory passage in the compressor passing through the discharge chamber 132, the pressure supply channel 41, the crankcase 121, the internal channel 40, the suction chamber 131 and the cylinder bores 111. Therefore, if the refrigerant gas flows from the external refrigerant circuit 45 back to the discharge chamber 132 when the cam plate 23 has shifted to its minimum angle of inclination, the pressure in the crankcase 121 becomes higher than normal conditions in which such backflow of the refrigerant gas does not occur. When the angle of inclination of the cam plate 23 is increased from its minimum angle of inclination, or when increasing the displacement capacity of the compressor, the lower the internal pressure of the crankcase 121, the quicker the desired displacement capacity will be restored. It is therefore appreciated that the above-described backflow-preventing effect of the check valve 69 helps accelerate a process of restoring the displacement capacity.

(6) In this embodiment, the outflow opening of the channel segment 114*b*, through which the refrigerant gas discharged from the individual cylinder bores (compression space) 111 passes, opens at a curved outer surface of the rear housing block 13 and the dampening or muffler chamber 65 is provided immediately downstream of the output channel 114. Accordingly, the refrigerant gas delivered to the external refrigerant circuit 45 through the output channel 114 inevitably goes through the dampening chamber 65. Since heat is exchanged through an outer wall of the dampening chamber 65 which produces a dampening or muffler effect in this construction, it is possible to enhance the cooling efficiency of the compressor.

(7) In this embodiment, the channel segment 114*a* forming part of the output channel 114 is preferably formed at right angles to the rear end surface (butt end to be joined to the rear housing block 13) of the cylinder block 11 and has a circular opening in cross section. On the other hand, the front part of the channel segment 114*b* is formed at right angles to the front end surface (butt end to be joined to the cylinder block 11) of the rear housing block 13 and has a circular opening in cross section. Since the openings of both the channel segments 114*a* and 114*b* have a circular shape, it is possible to minimize the opening area of each channel segment 114*a*, 114*b* in relation to the area of the butt ends of the cylinder block 11 and the rear housing block 13. Furthermore, it is possible to minimize the openings formed corresponding to the channel segments 114*a* and 114*b* in the gaskets which are placed between the valve-forming plate 15 and the cylinder block 11 and between the valve-forming plate 16 and the rear housing block 13, although the gaskets are not specifically illustrated.

While the invention has been described with reference to its preferred embodiment, the invention is not limited in its application to the details of the foregoing embodiment but may be varied in various ways without departing from the true spirit and scope of the invention. Some examples of such variations are described in the following.

In the foregoing preferred embodiment, the raised step 66 is formed on a cylindrical inner surface of the accommodating compartment 132*a* so that the flange 73*a* can be seated on the raised step 66, and when the check valve 69 is fitted into the accommodating compartment 132*a* in a manner that the flange 73*a* is properly seated on the raised step 66, the snap ring 74 fitted in the cylindrical inner surface of the accommodating compartment 132*a* prevents the check valve 69 from coming off the accommodating compartment 132*a*. In one variation of the invention, the check valve 69 may be press-fitted into the accommodating compartment 132*a*. This variation makes it possible to eliminate the snap ring 74 and the raised step 66 and thereby achieve simplification of the overall construction.

Instead of press-fitting the check valve 69 into the accommodating compartment 132*a*, the check valve 69 may be fixed by screwing it into the accommodating compartment 132*a*. This is accomplished by forming external threads around the flange 73*a* and internal threads on the cylindrical inner surface of the accommodating compartment 132*a*. In this variation, a slot-like or crisscross groove must be formed in an outer end surface of the stopper 73 in the check valve 69 to permit the use of a screwdriver.

Although there is formed the throttle channel 123 in the foregoing preferred embodiment, the invention is applicable also to a compressor which is not provided with the throttle channel 123. The check valve 69 is closed when the compressor is not run in this variation as well, so that no lubricating oil (dead oil) will deposit inside the dampening or dampening chamber 65.

Although the invention is applied to the clutchless compressor in the foregoing preferred embodiment, it may be embodied in any other types of compressors which can employ a discharge muffler, including those provided with a clutch.

Given below is technological essence which can be derived from the foregoing description of the preferred embodiment.

A compressor according to the present invention, in which an outflow opening of an output channel, through which a refrigerant gas discharged from a compression space passes, opens at a curved outer surface of a rear housing block and a discharge muffler is provided at the outflow opening of the output channel. In this construction, the refrigerant gas discharged through the output channel passes through the discharge muffler before it is delivered to an external refrigerant circuit. Since heat is exchanged through an outer wall of the discharge muffler which produces a sound-deadening effect, it is possible to enhance the cooling efficiency of the compressor. In addition, the refrigerant gas discharged from the compression space passes through an open/close device first, and then passes through a dampening chamber located in the discharge passage downstream of the open/close device. In this construction, the dampening chamber reduced pressure pulsations in the discharged gas resulting from the compression space, as well as, from hunting (opening and closing) of the open/close device. Since pressure pulsations are absorbed by the dampening chamber, it is possible to reduce the adverse affects of pressure pulsations on the external refrigerant circuit.

In addition, the reliability of the lip seal can be increased by placing the open/close device upstream of the dampening chamber, thereby reducing the volume of hot compressed air that is allowed to flow back into the compressor from the external refrigerant circuit and the dampening chamber when the compressor is stopped.

What is claimed:

1. A compressor for use with an external refrigerant circuit, said compressor comprising:

a discharge chamber formed in said compressor for receiving a compressed gas;

a discharge passage formed in said compressor and extending from said discharge chamber to said external refrigerant circuit;

an open/close device disposed in said discharge passage, wherein said open/close device controls a flow of said compressed gas; and a dampening chamber formed in said discharge passage on a downstream side of said open/close device, wherein said dampening chamber reduces pressure pulsations in said compressed gas.

2. The compressor of claim 1 wherein said compressor is a variable displacement type compressor.

3. The compressor of claim 1 wherein said open/close device is a check valve.

4. The compressor of claim 1 wherein said dampening chamber is a muffler.

5. The compressor of claim 1 wherein said open/close device further comprises a valve element and a closure spring, wherein said open/close device is opened by a high pressure gas discharged from said discharge chamber acting on an upstream side of said valve element, and said open/close device is closed by a combination of said closure spring and a high pressure gas acting on a downstream side of said valve element.

6. The compressor of claim 1 further comprising:

a housing having a front end and a rear end;

said housing further comprising:

a front housing block disposed proximate said front end of said housing;

a cylinder block housing coupled to a rear end of said front housing block; and a rear housing block coupled to a rear end of said cylinder block housing;

an accommodating compartment formed by a joint surface of said rear housing block and said cylinder block housing; and wherein said open/close device is disposed in said accommodating compartment.

7. A compressor for use with an external refrigerant circuit, said compressor comprising:

a suction chamber;

a compression chamber connected to said suction chamber, said compression chamber positioned on a downstream side of said suction chamber;

a discharge chamber connected to said compression chamber, said discharge chamber positioned on a downstream side of said compression chamber;

a discharge passage connected to said discharge chamber, said discharge passage positioned on a downstream side of said discharge chamber and extending from said discharge chamber to said external refrigerant circuit;

an open/close device disposed in said discharge passage; and a dampening chamber disposed in said discharge passage, said dampening chamber being positioned in said discharge passage on a downstream side of said open/close device.

8. The compressor of claim 7 wherein said compressor is a variable displacement type compressor.

9. The compressor of claim 7 wherein said open/close device is a check valve.

10. The compressor of claim 7 wherein said dampening chamber is a muffler.

11. The compressor of claim 7 wherein said open/close device further comprises a valve element and a closure spring, wherein said open/close device is opened by a high pressure gas discharged from said discharge chamber acting on an upstream side of said valve element, and said open/close device is closed by a combination of said closure spring and a high pressure gas acting on a downstream side of said valve element.

12. The compressor of claim 7 further comprising:

a housing having a front end and a rear end;

said housing further comprising:

a front housing block disposed proximate said front end of said housing;

a cylinder block housing coupled to a rear end of said front housing block; and a rear housing block coupled to a rear end of said cylinder block housing;

an accommodating compartment formed by a joint surface of said rear housing block and said cylinder block housing; and wherein said open/close device is disposed in said accommodating compartment.

13. A compressor for use with an external refrigerant circuit, said compressor comprising:

a housing having a front housing block, a cylinder housing block coupled to a rear end of said front housing block, and a rear housing block coupled to a rear end of said cylinder housing block;

a suction chamber formed in said rear housing block;

a compression chamber formed in said cylinder housing block, said compression chamber positioned on a downstream side of said suction chamber;

a discharge chamber formed in said rear housing block, said discharge chamber positioned on a downstream side of said compression chamber;

a discharge passage extending from said discharge chamber to said external refrigerant circuit;

an accommodating compartment formed in said discharge passage by a joint surface of said cylinder housing block and said rear housing block, said accommodating chamber positioned on a downstream side of said discharge chamber;

an open/close device disposed in said accommodating compartment; and a dampening chamber formed in said discharge passage on a downstream side of said accommodating compartment.

14. The compressor of claim 13 wherein said compressor is a variable displacement type compressor.

15. The compressor of claim 13 wherein said open/close device is a check valve.

16. The compressor of claim 13 wherein said dampening chamber is formed bridging a joint between said cylinder block and said front housing block.

17. The compressor of claim 13 wherein said dampening chamber is a muffler.

18. The compressor of claim 13 wherein said open/close device further comprises a valve element and a closure spring, wherein said open/close device is opened by a high pressure gas discharged from said discharge chamber acting on an upstream side of said valve element, and said open/close device is closed by a combination of said closure spring and a high pressure gas acting on a downstream side of said valve element.

19. A compression system having a flow of gas from an area of low pressure to an area of high pressure, said system comprising;

a condenser;

an expansion valve;

an evaporator;

a compressor; and a refrigerant circuit connecting said condenser to said expansion valve, said expansion valve to said evaporator, said evaporator to said compressor and said compressor to said condenser;

wherein said compressor comprises a circulatory passage, said compressor circulatory passage further comprising:

means for receiving a low pressure gas from said refrigerant circuit;

means for compressing said low pressure gas to form a high pressure gas;

means for discharging said high pressure gas from said means for compressing to said refrigerant circuit;

means for controlling said discharge of said high pressure gas; and means for dampening pressure pulsations in said high pressure gas, said means for dampening being disposed on a downstream side of said controlling means.

20. The system of claim 19, wherein said discharging means further comprises an accommodating compartment formed in a discharge passage, and wherein said controlling means further comprises an open/close device, said open/close device being disposed in said accommodating compartment.

21. The system of claim 19 wherein said means for controlling is a check valve.

22. The system of claim 19 wherein said means for dampening pressure pulsations is a dampening chamber positioned in said discharge passage downstream of said open/close device.

23. A compressor connected to an external refrigerant circuit, said compressor comprising a discharge passage having a means for minimizing pressure pulsations generated in said compressor from affecting said external refrigerant circuit.

24. The compressor of claim 23 wherein said means for minimizing pressure pulsations further comprises a dampening chamber and an open/close device, wherein said dampening chamber is disposed in said compressor in said discharge passage on a downstream side of said open/close device, said discharge passage extending from a discharge chamber to said external refrigerant circuit.

25. A compressor connected to an external refrigerant circuit, said compressor comprising a discharge passage having a means for reducing the amount of a high pressure discharge gas that is allowed to flow back into said compressor when said compressor is stopped.

26. The compressor of claim 25 wherein said means for reducing the amount of said high pressure discharge gas that is allowed to flow back into said compressor further comprises a dampening chamber and an open/close device disposed in said discharge passage, wherein said open/close device is disposed in said discharge passage on an upstream side of said dampening chamber, said discharge passage extending from a discharge chamber to said external refrigerant circuit.

27. A method of operating a compression system comprising the steps of:

providing a gas flow circuit having a high pressure area and a low pressure area;

receiving a low pressure gas from said low pressure area of said gas flow circuit;

compressing said low pressure gas to form a high pressure gas;

discharging said high pressure gas to a discharge passage in said high pressure area of said gas flow circuit;

controlling said flow of said high pressure gas in said discharge passage between said high pressure area and said low pressure area; and dampening pulsations in said discharge of said high pressure gas in said discharge passage on a downstream side of said step of controlling.

28. The method of claim 27, wherein said step of controlling further comprises the steps of:

forming an accommodating compartment in said discharge passage;

disposing an open/close device in said accommodating compartment;

opening said open/close device when an upstream pressure of said discharged high pressure gas on an upstream side of said open/close device is greater than the sum of a spring pressure and a downstream pressure on a downstream side of said open/close device; and closing said open/close device when said sum of said spring pressure and said downstream pressure on said downstream side of said open/close device is greater than said upstream pressure on said upstream side of said open/close device.

29. A system for suppressing pressure pulsations in a high pressure gas, the system comprising:

an external refrigerant circuit;

a compressor having a suction for receiving a low pressure gas from said external refrigerant circuit and a discharge for discharging a high pressure gas to said external refrigerant circuit, wherein said compressor comprises;

a discharge chamber;

a discharge passage extending from said discharge chamber to said external refrigerant circuit;

an open/close device disposed in said discharge passage; and a dampening chamber formed in said discharge passage, said dampening chamber being positioned in said discharge passage on a downstream side of said open/close device.

30. The system of claim 29 further comprising an accommodating compartment, wherein said accommodating compartment is formed in said discharge passage.

31. The system of claim 30 wherein said open/close device is disposed in said accommodating compartment.

32. The system of claim 29 wherein said open/close device is a check valve.

33. The system of claim 29 wherein said dampening chamber is a muffler.

34. A compressor foruse with an external refrigerant circuit, said compressor comprising:

a housing having a front housing block, a cylinder housing block coupled to a rear end of said front housing block, and a rear housing block coupled to a rear end of said cylinder housing block;

a suction chamber formed in said rear housing block;

a compression chamber positioned on a downstream side of said suction chamber in said cylinder housing block;

a discharge chamber positioned on a downstream side of said compression chamber in said rear housing block;

a discharge passage extending from said discharge chamber to said external refrigerant circuit;

an accommodating compartment formed in said discharge passage, said accommodating chamber positioned on a downstream side of said discharge chamber;

an open/close device disposed in said accommodating compartment;

a dampening chamber formed in said discharge passage on a downstream side of said accommodating compartment; and wherein said open/close device is closed when said compressor is not in operation.

35. The compressor of claim 34, wherein an upstream side of said accommodating compartment is open to said discharge chamber and a downstream side of said accommodating compartment is open to said dampening chamber.

36. The compressor of claim 34 wherein said compressor is a variable displacement compressor, said variable displacement compressor further comprising:

a cylinder bore formed in said cylinder block of said housing;

a crankcase formed in said housing;

a drive shaft rotatably supported between said front housing block and said cylinder block of said housing;

a piston disposed in said cylinder bore;

a cam plate positioned in said crankcase, said cam plate being slidably supported by said rotary drive shaft, said cam plate being capable of sliding along said drive shaft and inclining in an axial direction of said drive shaft;

a shoe disposed between and slidably connecting said cam plate and said piston;

wherein a rotational motion of said cam plate is converted into a reciprocating motion of said pistons;

wherein the displacement capacity of said compressor is varied by controlling an angle of inclination of said cam plate in accordance with the difference between an internal pressure of said crankcase and a suction pressure present on both side of said piston.

* * * * *